United States Patent [19]

Koslow

[11] Patent Number: 4,471,547

[45] Date of Patent: Sep. 18, 1984

[54] IDENTIFICATION INSERT FOR LABELING DRAWINGS OR THE LIKE AND METHOD THEREFOR

[76] Inventor: Richard Koslow, 866 Gardenway, Ballwin, Mo. 63011

[21] Appl. No.: 341,548

[22] Filed: Jan. 21, 1982

Related U.S. Application Data

[63] Continuation-in-part of Ser. No. 232,718, Feb. 9, 1981.

[51] Int. Cl.[3] ..... G09F 3/00

[52] U.S. Cl. ..... 40/309; 242/1

[58] Field of Search ..... 40/10, 309, 20, 310, 40/2 R; 242/1

[56] References Cited

U.S. PATENT DOCUMENTS

| | | | |
|---|---|---|---|
| 285,755 | 9/1883 | Kidd | 40/309 |
| 286,112 | 10/1883 | Buck | 40/309 |
| 310,201 | 1/1885 | Hawkins | 40/309 |
| 1,738,378 | 12/1929 | Little | 40/309 |
| 2,537,184 | 1/1951 | Dunn | 40/309 |
| 3,718,999 | 3/1973 | Voyce | 40/309 |

FOREIGN PATENT DOCUMENTS

| | | | |
|---|---|---|---|
| 480550 | 5/1953 | Italy | 40/309 |

*Primary Examiner*—Gene Mancene
*Assistant Examiner*—Wenceslao J. Contreras
*Attorney, Agent, or Firm*—Grace J. Fishel

[57] ABSTRACT

An identification insert for inserting into one end of a rolled drawing for identifying said rolled drawing from a stack of similarly rolled drawings and the method thereof is disclosed. The insert is a tubular member with an outwardly extending flange at its rearward end and at least one longitudinal slot extending from adjacent its rearward end and opening at its forward end. The outwardly extending flange provides a surface for identifying indicia such that the drawing can be easily identified when viewed from the end into which the insert is inserted. The identification insert is circumferentially compressible at its forward end such that in one mode of use it exerts a wedging effect against the innermost layers of the roll as its forward end is inserted therein. In another mode, the inner lap of the rolled drawing is caught in said longitudinal slot and the rolled drawing tightened on the insert by holding the inner lap of the drawing such that it will not slip on the insert and twisting the insert in the direction that the drawing is rolled. In a still further mode, the inner lap of the rolled drawing is wedged in said longitudinal slot.

3 Claims, 12 Drawing Figures

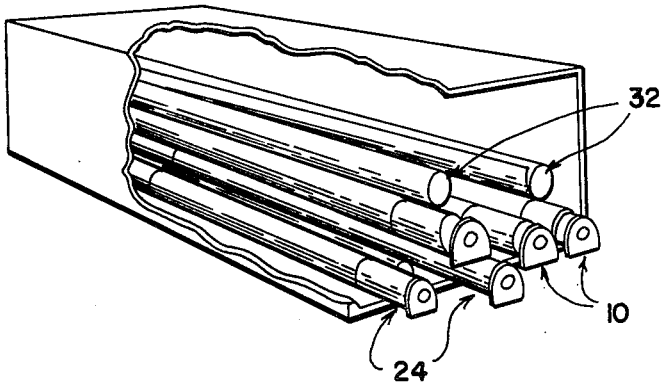
FIG. 1
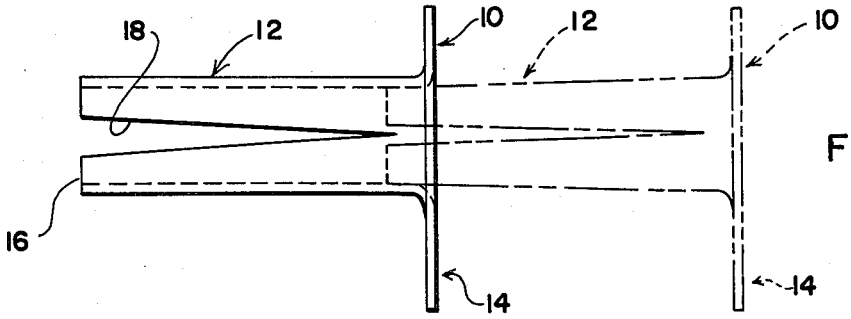
FIG. 2
FIG. 4
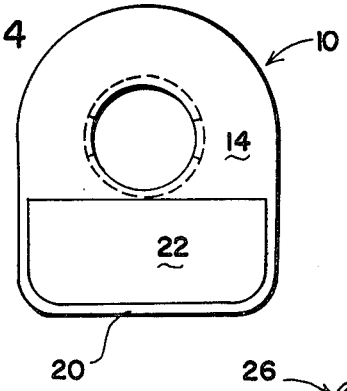
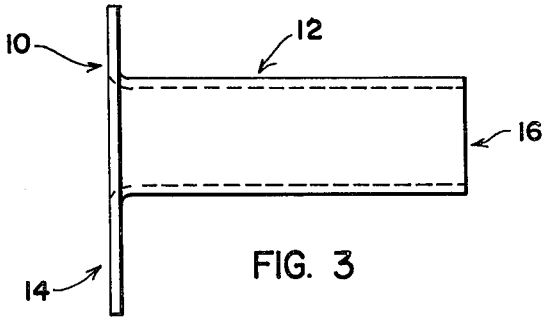
FIG. 3
FIG. 5
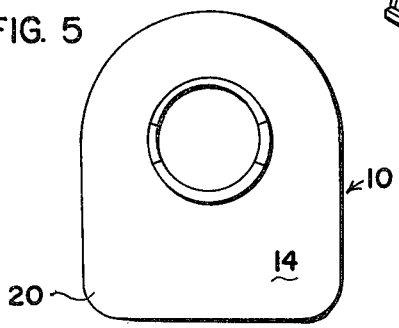
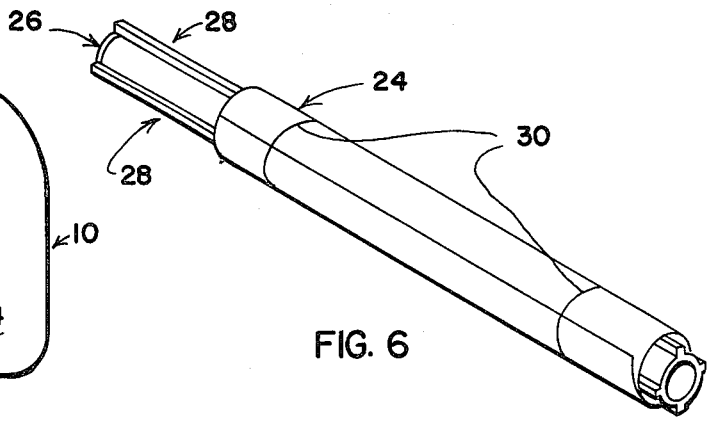
FIG. 6

IDENTIFICATION INSERT FOR LABELING DRAWINGS OR THE LIKE AND METHOD THEREFOR

This application is a continuation-in-part of Ser. No. 232,718, filed Feb. 9, 1981 for *Roll End Plug for Labeling Drawings or the Like and Method Therefor.*

The present invention relates to an identification insert for labeling drawings or the like and to a method therefor.

Most mechanical and architect's drawings are made upon large sheets of paper which are not suited for storage in ordinary letter or legal sized files. Drawings can of course be folded to fit into a standard filing cabinet but this is not typically done since the folds distort the drawing and make it difficult for the user to take off accurate measurements and hence the preferred way for storing drawings is flat or in rolls. Similar problems are also encountered with maps, charts, graphs and the like, with which the present invention is also useful.

There are special purpose filing cabinets for storing drawings flat or rolled up in shallow drawers or pigeonholes and there are vertical racks for hanging them from clamps. This special filing equipment is expensive and takes a lot of floor space such that many users of drawings like plumbers, electricians and painters simply get along without it. The storage system used by many building trade contractors comprises rolling the drawings into rolls, securing the rolls with rubber bands and stacking the rolls wherever there is a flat space for stacking them. Not untypically, they are piled on top of an ordinary filing cabinet, stood vertically in a cardboard box or otherwise informally stored.

The present invention is directed towards the needs of those drawing users who cannot or do not want to afford special purpose filing equipment. The primary problem for these users, other than where to pile the drawings, is in identifying a drawing in a stack of rolled drawings without unrolling each and every drawing until the right one is found. Most mechanical and architect's drawings are identified with a title block which is drawn on the face of the drawing but when the drawing is rolled it must be unrolled before the title block can be read. Addressing this problem, many users write a short description on the outside of the drawing but this does not totally solve the identification problem as each roll must be partly pulled out of the stack and held sideways to the user so that he can read the notation on the end of the drawing until the right drawing is located. This is a particularly frustrating process when an immediate answer is wanted and the questioning party has been put on hold.

In view of the above, there is a need for an inexpensive identification insert for labeling drawings or the like so that the user can easily identify and select the desired drawing from a pile of rolled drawings by reference to readily readable indicia provided therefor on the above-mentioned insert. It is therefore an object of the present invention to provide an identification insert for labeling drawings or the like and to the method therefor. Other objects and features will be in part apparent and in part pointed out hereinafter. The invention accordingly comprises the constructions and methods hereinafter described, the scope of the invention being indicated in the subjoined claims.

In the accompanying drawings, in which one of various possible embodiments of the invention is illustrated, corresponding reference numerals refer to corresponding parts and in which:

FIG. 1 is a perspective view of a pile of rolled drawings, most of which have been labeled with an identification insert in accordance with the present invention;

FIG. 2 is a side elevational view of a first identification insert with a second insert shown in dotted lines being inserted therein, said inserts having a pair of symmetrically spaced apart longitudinal slots;

FIG. 3 is a top view of the insert shown in FIG. 2;

FIG. 4 is a right hand end view of the insert shown in FIG. 2;

FIG. 5 is a left hand end view of the insert shown in FIG. 2;

FIG. 6 is a perspective view of a drawing rolled around a fluted mandrel prior to the insertion of an insert as shown in FIGS. 2–5;

Figure 7:
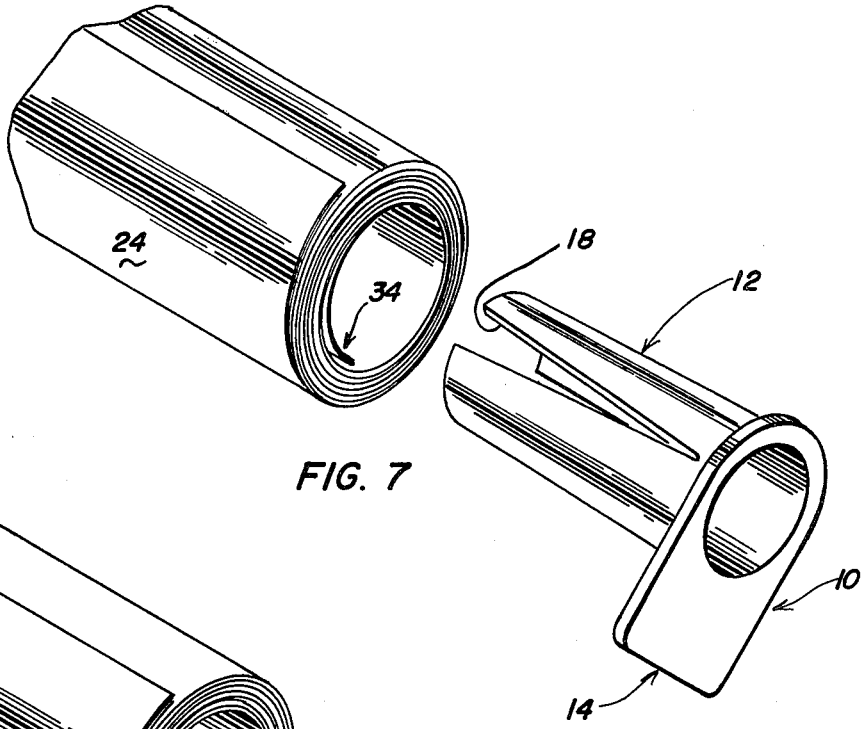
FIG. 7 is a perspective view of an insert being wedged into a roll of drawings.

Referring to the drawings more particularly by reference character, reference numeral 10 refers to an identification insert for labeling drawings or the like in accordance with the present invention. As shown in FIGS. 2–5, insert 10 comprises an elongated tubular member 12, which is outwardly flanged at or adjacent its rearward end into an outwardly projecting collar tab 14 as more particularly described hereinafter. As best seen in FIG. 2, the forward end of tubular member 12 is preferably chamfered around its leading edge 16 and includes at least one slot extending from adjacent its rearward end and opening at its forward end, shown as a pair of symmetrically spaced apart longitudinal slots 18 opening outwardly from adjacent tab 14 to leading edge 16. Slot 18 is preferably no wider than necessary to provide for circumferential compressibility and to receive the thickness of the inner lap of the largest roll of drawings intended for use therewith so as to maximize the contact between the outer walls of member 12 and the inner surfaces of the rolled drawing.

Depending on the material from which insert 10 is made, tab 14 may be integrally formed with tubular member 12 or it may be simply attached thereto. However formed, it is preferred that tubular member 12 be open ended at tab 14 such that a second insert 10, as shown in FIG. 2, can be nested therein for storage but it is essential that tab 14 be of a size so that readily readable indicia can be inscribed thereon. In the preferred embodiment which is shown in the drawings, tab 14 comprises an annular flange which is elongated in one direction and flattened for a distance along its periphery 20 such that there is sufficient area on the tab for attachment of a standard stationer's label 22 or the like bearing the aforementioned identifying indicia and for keeping the drawing from rolling when set upon a flat surface. If desired, insert 10 can be color coded so that drawings of a particular type are marked with similarly colored inserts. In this way, drawings from a particular architect, year, project, company or the like can be easily identified from a mixed stack of drawings.

In one mode of use, a drawing 24 is rolled around a mandrel 26 as shown in FIG. 6. For reasons to be described hereinafter mandrel 26 is preferably a cylinder, fluted at 28 and longer than the drawing is wide. After drawing 24 is wound on mandrel 26, it is secured in rolled condition by securing means 30 shown as a pair of rubber bands. Mandrel 26 is then withdrawn from the roll by grasping the drawing with one hand and pulling the mandrel with the other hand where it extends beyond the drawing 24. It is preferred that mandrel 26 include a plurality of longitudinal flutes 28 so that the mandrel can be more easily withdrawn from rolled drawing 24 without binding.

Once mandrel 26 has been withdrawn from roll 24, end insert 10 is inserted into one of the rolled ends. The diameter of mandrel 26 is such that the inside diameter of roll 24 is slightly less than the outside diameter of tubular member 12 for a snug fit. Thus as the chamfered edge 16 of tubular member 12 is inserted into roll 24, insert 10 exerts a wedging effect on the innermost layers of the roll. It will be readily appreciated that tube 12 must be somewhat flexible and circumferentially compressible along slots 18 such that insert 10 can be wedged into roll 24 as shown in FIG. 7 without crushing or tearing the inner windings of the roll as it is inserted.

Suitable identifying indicia are applied to tab 14, for example with label 22, and roll 24 is ready for stacking with other rolls as shown in FIG. 1, most of which are similarly marked. Thereafter, roll 24 can be readily selected from the stack by reference to label 22 on tab 14 without unrolling the drawing to look at the title block and without partially pulling the drawing out of the stack to read the notation on the outside, if there is any, as is necessary in the case of unmarked drawings 32. Thus the user can easily maintain an inventory of drawings, immediately respond to questions about them and once his need for a particular drawing has ended, he can reuse insert 10 with another drawing simply by changing label 22.

Figure 8:
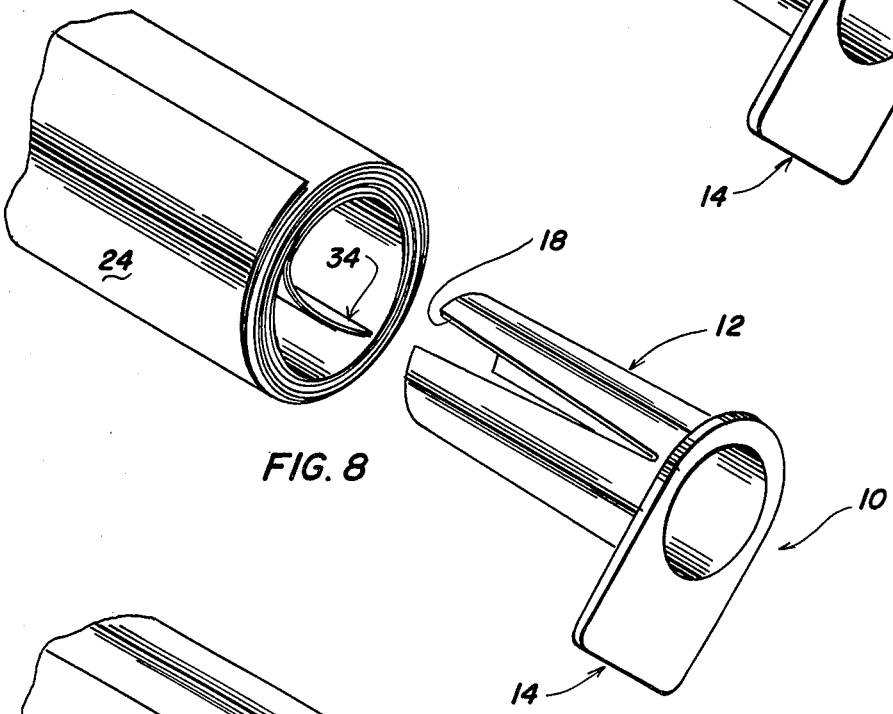
FIG. 8 is a perspective view of the inner lap of a rolled drawing being caught in the longitudinal slots of said insert.
Figure 9:
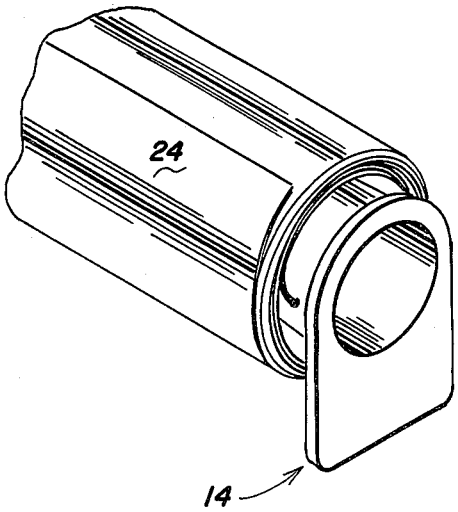
FIG. 9 is an end view of the insert after it has been inserted into the rolled drawing shown in FIG. 8 and the drawing tightened thereon.

In another mode of use as shown in FIGS. 8 and 9, an inner lap or winding 34 of rolled drawing 24 is caught or passed between slots 18 as insert 10 is inserted into one end of the roll. In this mode, drawings 24 may be rolled on mandrel 26, if desired, or simply rolled in a conventional manner and secured with rubber bands 30 or the like. Drawing 24 is tightened on insert 10 by twisting insert 10 counterclockwise, as shown in FIG. 8 to FIG. 9, but more generally, it is twisted in the direction that said drawing is rolled. As insert 10 is twisted, the drawing is tightened on the insert which exerts a tensile force on the inner laps of the drawing making it more rigid such that the entire roll takes on a rigidity as though it were wound on a cardboard core. For this to occur, however, inner lap 34 must not slip out of slots 18 such that the inner lap merely slides on the outer surface of tubular member 12 without gripping and twisting the paper since in this condition substantially no tensile force is applied to the inner windings of the drawing. If the thickness of the roll is not sufficient to prevent inner lap 34 from sliding out of slots 18, the user may simply press the inner lap against the inner wall of tubular member 12 after the insert has been inserted into the drawing and while the insert is being rotated. If drawings 24 are stapled together with a flap (not shown), the flap or the staples may catch on slots 18 and serve the same purpose as pressing inner lap 34 against the inside of tubular member 12.

In the modes described above, it is important that slots 18 be no wider than necessary to give circumferential compressibility (in the case of the first mode) and to receive the inner lap of the drawing (in the case of the second mode). Since insert 10 is designed for universal use, it is important that both functions be achieved in the same insert over the spectrum of drawings encountered in practical application.

Figure 10:
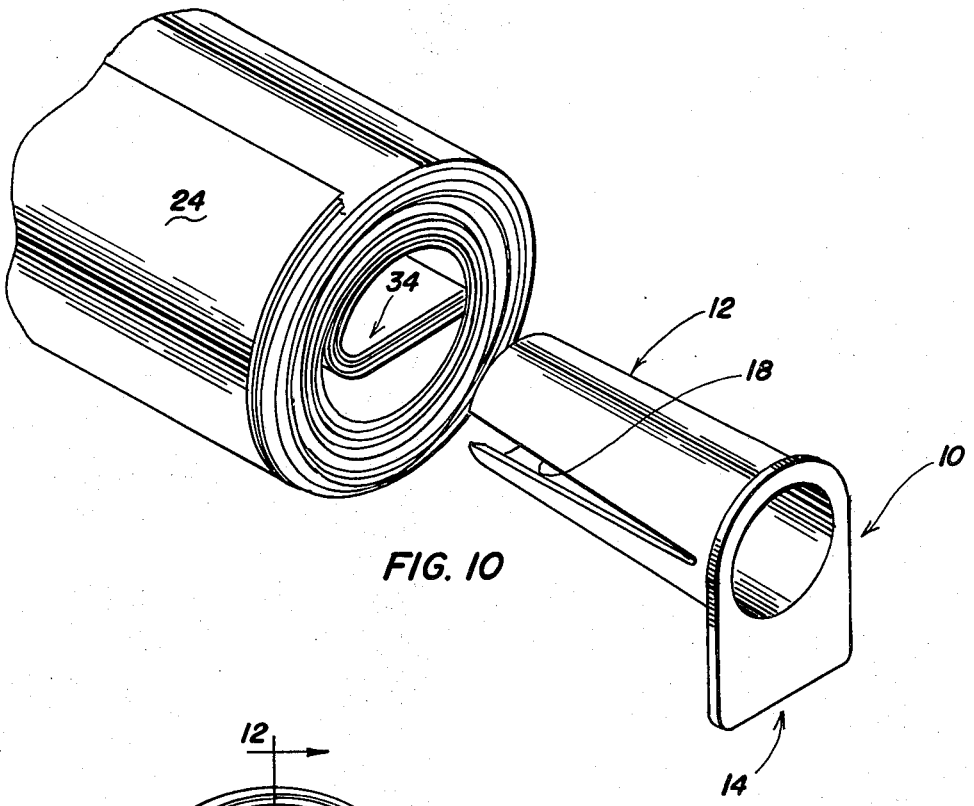
FIG. 10 is a perspective view of the inner lap of a a large roll of drawings being wedged into the longitudinal slots of the insert.
Figure 11:
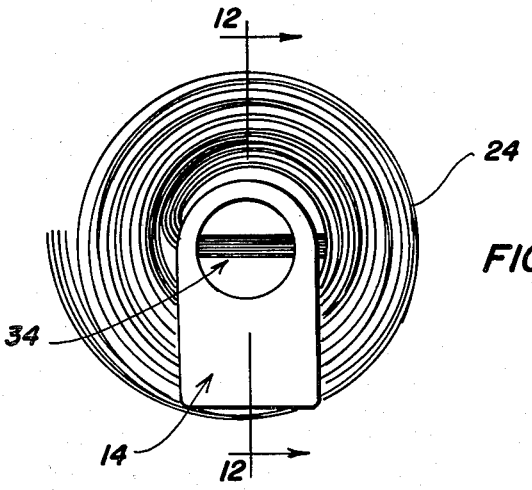
FIG. 11 is an end view of the insert after it has been inserted into the drawing shown in FIG. 10; and, FIG. 12 is a sectional view taken along line 12—12 in FIG. 11.
Figure 12:
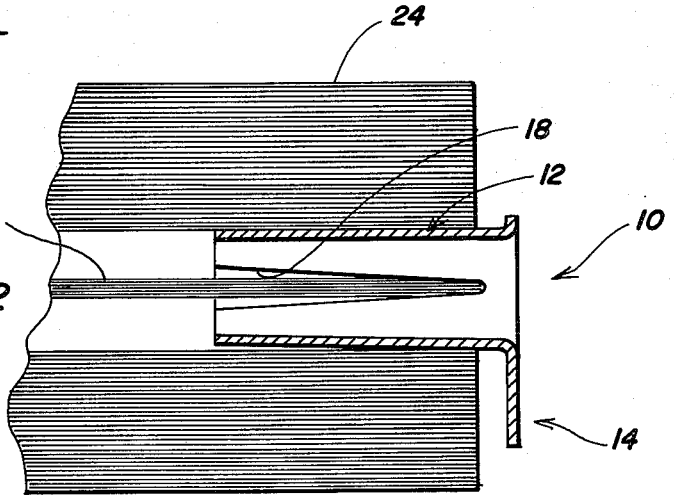

In a still further mode of use as shown in FIGS. 10–12, the roll of drawings 24 may be of sufficient size that it is rigid by virtue of the many thicknesses of paper. In this case, insert 10 may be used by wedging one end of inner lap 34 of drawings 24 between slots 18 as shown in FIG. 10 such that insert 10 is held in drawing 24 by friction force against the walls of slots 18 as shown in FIG. 12.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed is:

1. A method for identifying a drawing which comprises:

a. rolling the drawing;

b. applying securing means to the rolled drawing to maintain it in rolled condition;

c. separating the innermost winding of said drawing from the next most winding;

d. inserting an identification insert into one end of the rolled drawing and over one end of the innermost winding, said insert comprising a tubular member having forward and rearward ends, said tubular member having an outwardly extending flange at or adjacent its rearward end and at least one longitudinal slot extending from adjacent its rearward end and opening at its forward end, said innermost winding passing through said slot;

e. rotating said insert in the direction said drawing is rolled while preventing said innermost winding from slipping from said longitudinal slot whereby the drawing is tightened on said insert, said tubular member having substantially the same outer diameter as the inner diameter of the drawing which is tightened on said insert whereby the inner winding of the drawing is frictionally held under tensile force against said tubular member and the outer windings of the drawing are frictionally held under tensile force against each other, said outwardly extending flange bearing identifying indicia such that the drawing can be identified therefrom.

2. The method of claim 1 wherein the innermost winding of said drawing is prevented from slipping from said longitudinal slot during tightening of the drawing on the insert by means of the thickness of the innermost winding the end flap of which is wedged into said slot.

3. The method of claim 1 wherein the innermost winding of said drawing is prevented from slipping from said longitudinal slot during tightening of the drawing on the insert by means of pressure which is exerted by the user pressing the end flap of the innermost winding which is slipped into said slot against the inner surface of the tubular member.

* * * * *